United States Patent [19]

Kujubu

[11] 3,958,391

[45] May 25, 1976

[54] VACUUM PACKAGING METHOD AND APPARATUS

[75] Inventor: Eitaro Kujubu, Mihara, Japan

[73] Assignee: Kabushiki Kaisha Furukawa Seisakusho, Tokyo, Japan

[22] Filed: Nov. 14, 1975

[21] Appl. No.: 632,123

[30] Foreign Application Priority Data

Nov. 21, 1974 Japan ..... 49-134463

[52] U.S. Cl. ..... 53/22 B; 53/95; 53/112 B

[51] Int. Cl.[2] ..... B65B 31/02

[58] Field of Search ..... 53/7, 22 B, 91, 92, 53/93, 95, 96, 112 B

[56] References Cited

UNITED STATES PATENTS

| | | | |
|---|---|---|---|
| 3,006,120 | 10/1961 | Grafingholt | 53/95 |
| 3,511,021 | 5/1970 | Lyon et al. | 53/112 B |

*Primary Examiner*—Travis S. McGehee
*Attorney, Agent, or Firm*—Ladas, Parry, Von Gehr, Goldsmith & Deschamps

[57] ABSTRACT

A quantity of livestock meat for food is charged into a package bag made of a heat-shrinkable plastic film of substantially tubular shape of constant overall length sufficient for packaging variable quantities of the meat, the bag having a bottom end closed by transverse heat sealing and an open top end and being thus charged in a manner to leave an unfilled part between the seal and the meat, a surplus bag part being left outside of the seal, and this surplus part just outside of the seal is transversely and partially cut for subsequent serverence of the surplus bag part from the package bag, which is then immersed in hot water for a few seconds to cause shrinkage of the bag tightly around the meat. The vacuum packaging operation is advantageously accomplished in vacuum chambers formed by a continuity of vacuum boxes mating with corresponding platform plates in a vacuum packaging apparatus.

11 Claims, 21 Drawing Figures

VACUUM PACKAGING METHOD AND APPARATUS

BACKGROUND OF THE DISCLOSURE

This invention relates generally to packaging, particularly of foodstuffs, and more particularly to a vacuum packaging method and an apparatus in which, through the use of a packaging bag of a heat-shrinkable plastic film, vacuum packages containing a vacuum packaged foodstuff, particularly a livestock meat for food, are formed.

In a representative vacuum packaging method of similar character known and generally practiced heretofore, packages of hams, sausages, and like meat products are formed. This known method includes the package forming steps of filling a hollow cylindrical heat-shrinkable plastic film with the content to be packaged, constricting and closing the two open ends of the cylindrical film with clips, and thereafter causing the film to shrink with hot water. While this packaging expedient, strictly speaking, cannot be considered to evacuate fully the interior of the package, the package in this case is kept in the hot water for a time necessary for sterilization, and, therefore, no particular problem should arise thereafter.

On one hand, vacuum packages of raw meats of livestock packaged with the above mentioned packaging material formed into bags by a procedure comprising filling each bag through an open end thereof with the raw meat, inserting an evacuation nozzle into the opening of the bag and evacuating the bag, constricting and closing the opening with a clip, and causing the bag to shrink have been placed on the U.S. market and have been disclosed in the local trade journals.

In the case where the commodity packaged is raw meat, however, it is not possible to immerse each package in hot water for a period of time amply sufficient for thorough sterilization. For this reason, there is a high probability of decomposition and spoilage being caused by the nature of the closure of each bag by means of a clip, as described hereinafter. This packaging state is undesirable for food distribution and marketing.

Another difficulty encountered in vacuum packaging of the instant character is that the foodstuffs, particularly raw meats, are not uniform in size and shape. Still another difficulty is that the surfaces of meats, both raw and processed (e.g., bacon), are slightly damp and, moreover, tend to be tacky. These difficulties all cause difficulty in attaining full evacuation of the packaging bags and full suppression of generation of gases conducive to decomposition, and have required considerable preconditioning.

Accordingly, an efficient method by which it is possible to obtain full evacuation of each bag without the accompaniment of the above mention problems is urgently needed.

SUMMARY OF THE INVENTION

It is a principal object of this invention to provide a novel and improved vacuum packaging method and apparatus for packaging in the above described manner to obtain full evacuation of each bag without the accompaniment of the above mentioned problems.

According to this invention in one aspect thereof, briefly summarized, there is provided a method of vacuum packaging a commodity which is characterized by the steps of: charging a specific quantity of the commodity into a package bag made of a heat-shrinkable plastic film of a substantially constant overall length which is sufficient for packaging said quantity ranging from a relatively small quantity to a relatively large quantity of the commodity, and having a closed bottom end and an open top end, in a manner to leave a specific unfilled part at the bottom end of the bag; placing the bag thus charged in a specific position in an evacuating device of a vacuum packaging apparatus; placing the bag in said specific position under a vacuum thereby to evacuate the interior thereof, excessive inflation of the bag being prevented by means provided therefor; sealing the bag with a seal part extending transversely thereacross on the side of the commodity opposite from the bottom end of the bag, a specific unfilled part being left between the seal part and the commodity; at the same time cutting the bag with a cut extending transversely thereacross except for an uncut part for temporarily retaining the open end of the bag, constituting a surplus part, attached to the remainder of the bag, the cut being on the outer side of the seal part; removing the surplus part; and immersing the resulting vacuum package in hot water, preferably at a temperature of 80°C to 85°C for a period of the order of 2 to 10 seconds thereby to cause heat shrinkage of the bag.

According to this invention in another aspect thereof, there is provided apparatus for practicing the above described method, which apparatus comprises: a plurality of support members each adapted to hold thereon a package bag made of a heat-shrinkable plastic film and having a closed bottom end and an open top end and containing a specific quantity of a commodity with a specific unfilled part left at the bottom of the bag; a plurality of vacuum structures each adapted to mate with one of the support members to form therebetween an air-tight chamber accommodating the package bag, means for conveying the vacuum structures at a constant linear speed and with constant spacing therebetween along a first circulatory path; means for conveying the support members at said constant linear speed and with said constant spacing therebetween along a second circulatory path superimposed in a portion thereof relatively with the first circulatory path over a portion thereof and for moving the support members relatively into mating state with respective vacuum structures over said super-imposition portion and separating the support members from the respective vacuum structures at the end of said portion; means for evacuating said air-tight chambers; mean for preventing excessive inflation of each bag under vacuum; means provided within said chamber for sealing each bag with a seal part extending transversely thereacross on the side of the commodity opposite from the bottom end of the bag, a specific unfilled part being left between the seal part and the commodity; means provided within said chamber for cutting the bag with a cut extending transversely thereacross except for an uncut part for temporarily retaining the open end of the bag, constituting a surplus part, attached to the remainder of the bag; means for cutting openings in each bag in the surplus part on the outer side of said cut thereby to facilitate evacuation of the interior of the bag means for restoring the pressure within each vacuum chamber to atmospheric pressure upon completion of vacuum packaging therewithin; and means for transferring packages thus vacuum packaged from the support members onto means for conveying the packages to a succeeding process.

According to this invention in still another aspect thereof, there is provided a further improvement wherein the vacuum in vacuum chambers after completion of vacuum packaging is utilized by coomunication through a novel rotary valve mechanism to create a preliminary half vacuum in vacuum chambers about to be evacuated, whereby the power required for evacuation of vacuum chambers is greatly reduced.

The nature, principle, and utility as well as further features of the invention will be appararent from the following detained description with respect to preferred embodiments of the invention when read in conjunction with the accompanying drawings, which are briefly described below, and throughout which like parts are designated by like reference numerals.

DETAILED DESCRIPTION

Figure 1:
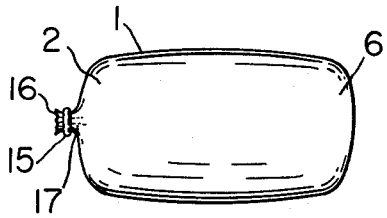
FIG. 1 PRIOR ART
FIGS. 1 and 2 are respectively a plan view and a side elevation showing one example of a known package containing a food product.
Figure 2:
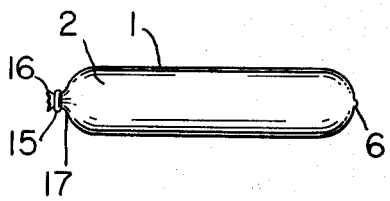
FIG. 2 PRIOR ART

As conducive to a full understanding of this invention, the problem briefly referred to hereinbefore will first be considered. As shown in FIGS. 1 and 2, the bag bottom part of the packaging bag of the afore mentioned known type can be assumed to be completely in intimate contact with the package contents as a result of heat shrinkage, but since the bag opening end is constricted and closed by a clip 15, wrinkles of the bag are concentrated in the immediate vicinity of the clip, and the overlapping of these wrinkles forms very small voids 17, which become a cause for imparting activity of microorganisms producing decomposition due to gases generated by the package content at a later date. Such a state is undesirable for distribution and marketing. Accordingly, there is a great need for a packaging method which affords a completely evacuated package state without any voids 17 whatsoever, and which, moreover, is efficient.

Figure 3:
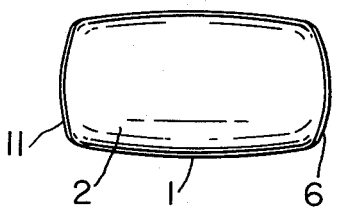
FIGS. 3 and 4 are respectively a plan view and a side elevation, in longitudinal section showing an example of a package containing a meat product vacuum packaged according to this invention.
Figure 4:
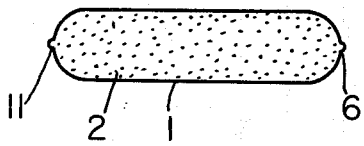
Figure 5:
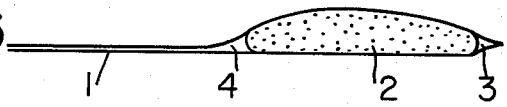
FIG. 5 is a side elevation, in longitudinal section, showing a package bag charged with a relatively small quantity of product according to the invention.
Figure 6:
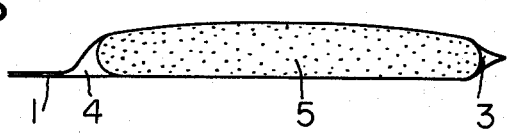
FIG. 6 is a view similar to FIG. 5 showing a package bag charged with a relatively large quantity of product according to the invention.

This need is fulfilled by this invention, in accordance with which a package as shown in FIGS. 3 and 4 is produced. In contrast to the known package shown in FIGS. 1 and 2, the package produced in accordance with this invention is heat sealed at both ends 6 and 11. The packaging material is a heat shrinkable plastic film 1, into which the content is charged in a quantity ranging from a minimum 2 indicated in FIG. 5 to a maximum 5 as indicated in FIG. 6. The packaging bag 1 is made in a substantially constant overall size sufficient for packaging the maximum quantity 5 of the content.

Figure 7:
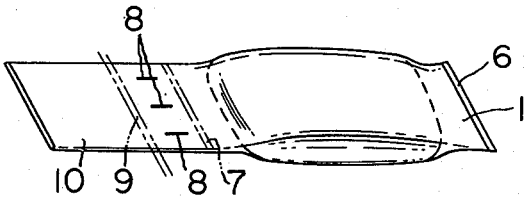
FIGS. 7 and 8 are perspective views respectively showing the charged package bags illustrated in FIGS. 5 and 6 and indicating parts which have been or are to be sealed and cut.
Figure 8:
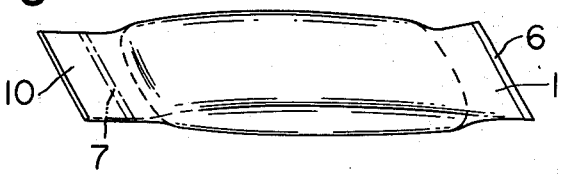

In the packaging process, the content, of a quantity in the range of from 2 to 5, is charged into the packaging bag 1 in a manner to leave a specific residual part 3 at the bottom part of the bag, and thereafter the bag is placed in a specific position of a vacuum packaging machine, as described more fully hereinafter, the position being such as to leave a specific residual part 4 at the bag opening end. In the vacuum packaging of a package content 2, as indicated in FIG. 7, slits are made along lines 8 by cutter blades 50 as described hereinafter for evacuation of the interior of the bag 1, and the portion of the bag on the outer side of the slit lines 8 is clamped and pressed along a clamp line 9 by a vacuum box as described hereinafter. After evacuation, the bag 1 is sealed along a seal line 7. After this vacuum packaging step, a surplus portion 10 of the bag 1 is left.

Figure 9:
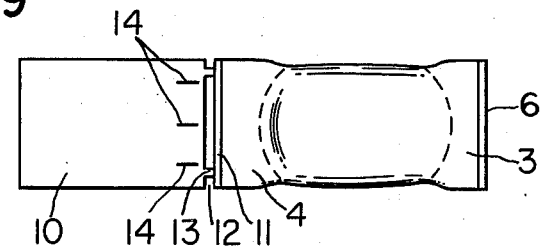
FIGS. 9 and 10 are respectively a plan view and a side elevation in longitudinal section showing the bag and product shown in FIGS. 5 and 7 after evacuation, sealing, and cutting according to the invention.
Figure 10:
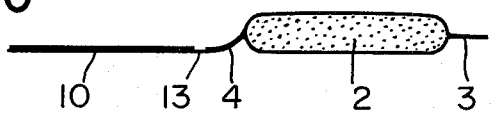

The state of the package after vacuum packaging is shown in FIGS. 9 and 10, in which state the opposite parts of the residual parts 3 and 4 of the bag are adhering flush against each other, and, moreover, the other parts of the bag are adhering completely and intimately to the surface of the content 2. Thereafter, the package is taken out of the vacuum packaging machine with the slits 14 remaining in the surplus part 10 of the package bag 1, which surplus part 10 is connected to the package by residual parts 13 left after a transverse cutting step.

In the succeeding step of immersion in hot water, the surplus part 10 is removed. It has been found that the optimum temperature of the hot water is from 80° to 85°C and that a suitable immersion time is from 2 to 10 seconds depending on the quantity (from 2 to 5) of the content. As a result of this immersion in hot water, the residual parts 3 and 4 of the package bag 1 shrink in accordance with the characteristic of the bag. It has also been found that, during this shrinkage, the wall thickness of the bag increases principally around the bag bottom sealed part 6 and the bag opening sealed part 11. As a result, these sealed parts 6 and 11, which ordinarily tend to be weakened by the juices of the contents, are actually and advantageously increased in the seal strength by this increase in the bag wall thickness.

As a result of the immersion of the package in the hot water, the entire package bag 1 shrinks, whereby the bag over its entire expanse adheres intimately to the entire surface of the contents. Accordingly, there is no possibility whatsoever of voids 17 remaining as in a conventional package as shown in FIG. 1 and 2, whereby the generation of gases from the contents at a later date is effectively suppressed.

The reason why the surplus part 10 of the package bag 1 is left attached to the bag and not completely separated therefrom at the time when the package is taken out of the vacuum packaging machine is as follows. If this surplus part 10 were to be completely separated at the time of vacuum packaging in the vacuum packaging machine, there would be the risk of the part 10 thus separated impairing the operation of the vacuum packaging machine, and therefore it is safer to leave the surplus part 10 attached to the package by way of the connective residual parts 13 and to take the part 10 out of the machine together with the package. Since the residual parts 13 are very small, the surplus part 10 can be removed in a simple manner at the time of immersion in the hot water.

Figure 11:
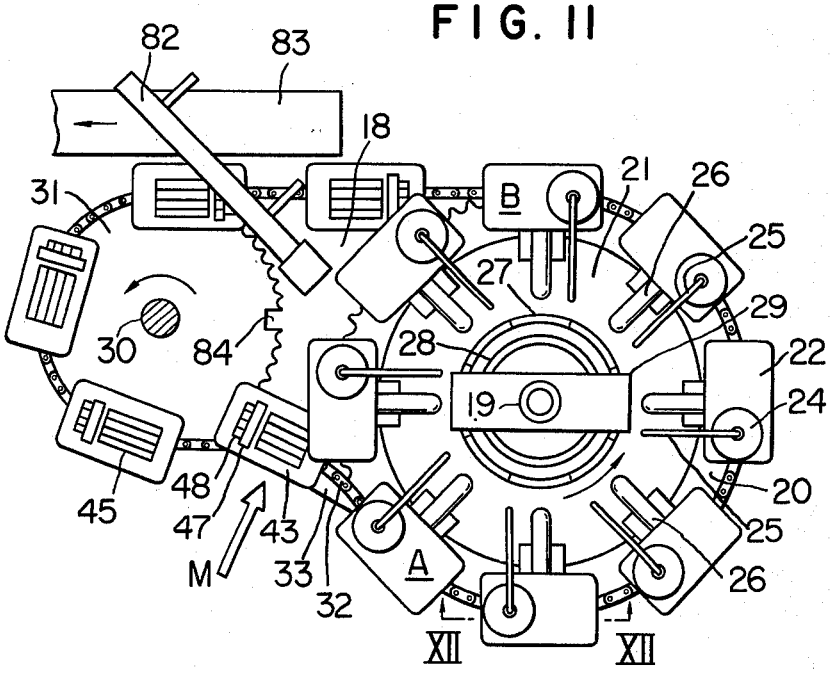
FIG. 11 is a plan view, with some parts deleted for the general organization of one example of a vacuum packaging apparatus according to the invention.

The above described packaging method can be practiced by means of a vacuum packaging machine according to this invention as described below with respect to one example thereof, the general arrangement of which is illustrated in FIG. 11. The machine has a machine frame 18 provided at one end thereof with a vertical hollow shaft 19 rigidly fixed at its lower end to the machine frame 18 and revolvably supporting a driven mechanism including a sprocket or chain wheel 20 provided with rotary valve mechanism and integrally fixed to a turntable 21, the chain wheel 20 being driven by an endless chain 32. Around the outer periphery of the turntable 21, at equaly spacing intervals, there are fixedly supported a plurality of vacuum boxes 22.

Figure 12:
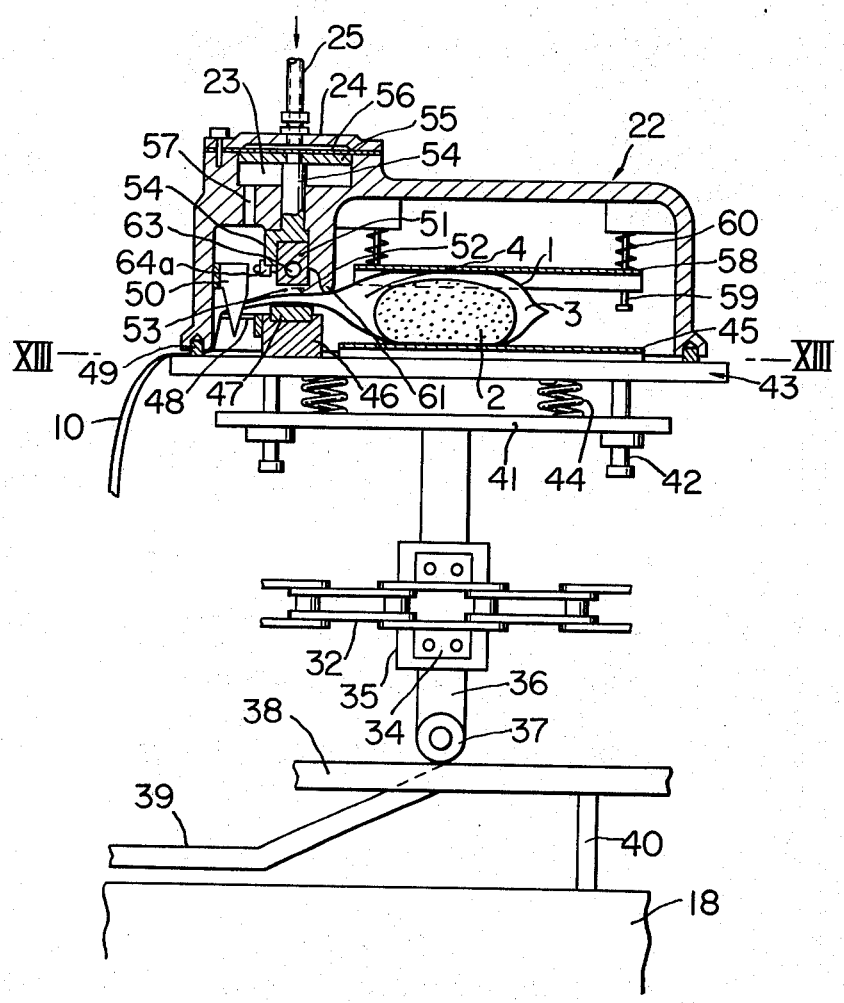
FIG. 12 is a side elevation, with some parts shown fragmentarily and some parts in vertical section taken on line XII-XII in FIG. 11, showing one vacuum box in mated state with a platform plate and thus forming an evacuation chamber wherein a commodity is being vacuum packaged according to the invention.
Figure 13:
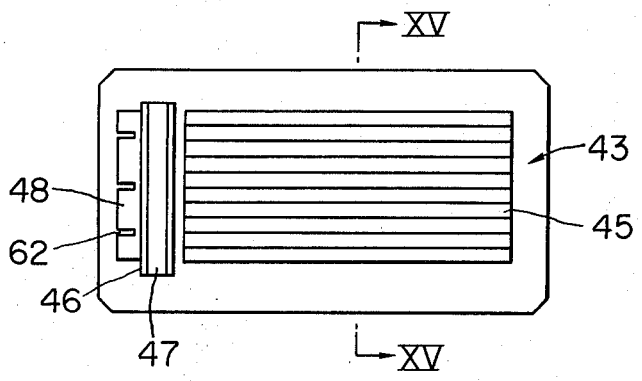
FIG. 13 is a plan view of the upper part of a platform plate.
Figure 14:
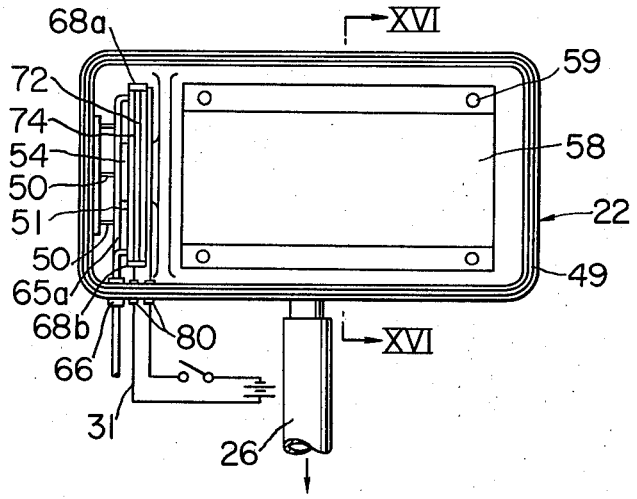
FIG. 14 is a bottom view of a vacuum box.
Figure 15:
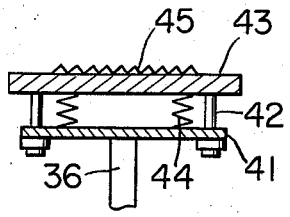
FIG. 15 is a cross section taken on line XV—XV in FIG. 13 and showing a platform plate provided with a corrugated retaining plate and supported elastically by a support plate.
Figure 16:
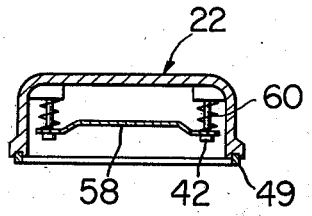
FIG. 16 is a cross section, taken on line XVI—XVI in FIG. 14, of the vacuum box shown in FIG. 14, showing means for preventing excessive inflation of the packaging bag during evacuation.
Figure 17:
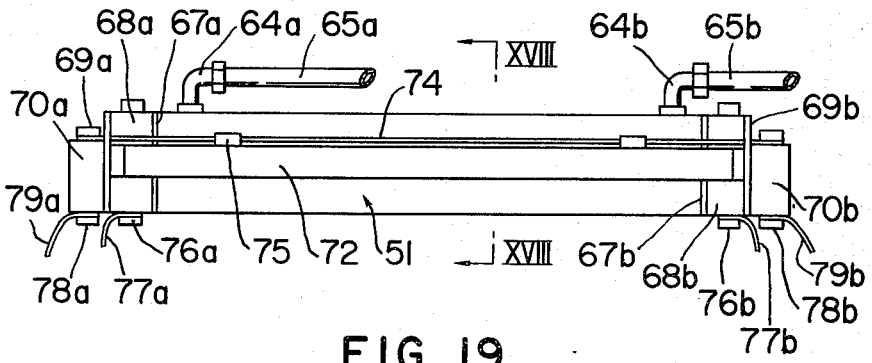
FIG. 17 is a relatively enlarged bottom view of a heater head installed in each vacuum box.

As shown in detail in FIGS. 12, 14 and 16, each of the vacuum boxes 22 is provided therewithin with a control plate 58 which has a concave lower face and is suspended by a suitable plural number of springs 60 of suitable spring constants, and which is free to move vertically under guidance of vertical guide posts 59 fixed to the vacuum box 22. Also within each vacuum box 22, a heater head 51 is supported transversely across the vacuum box by a heater head holder 54 at a position corresponding to the position of the seal line 11 of the open end of the package bag 1 and is coupled by way of the heater head holder 54 to a pressing device described below.

The package bag 1 after evacuation is sealed by an ordinary, pressure-and-heat sealing method, the pressure being applied by force applying means comprising a cylindrical pressure chamber 23 formed in the structure of the vacuum box 22 at a position vertically above the heater head 51, a piston disk 55 disposed within the pressure chamber 23 in a manner permitting its free sliding movement in the vertical direction and fixed to the heater head holder 54, a diaphragm 56 disposed coaxially on the piston disk 55, and a cover 24 constituting the upper roof of the pressure chamber 23 and secured to the vacuum box 22 together with the diaphragm 56.

A hose 25 is communicatively connected at one end thereof to a fitting in the cover and at the other end to the aforementioned rotary valve mechanism to be described in detail hereinafter. The lower part of the pressure chamber 23 is communicated to the interior of the vacuum box 22 through a hole 57 formed in an inner structural part of the box 22. This inner structural part of the box 22 is further formed to have a downward projection 61 disposed near the heater head holder 54 on the side thereof nearer the middle part of the vacuum box 22.

Figure 18:
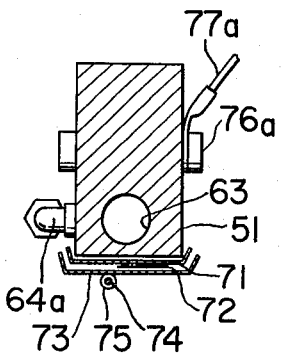
FIG. 18 is an elevation in section taken along the plane indicated by line XVIII—XVIII in FIG. 17.

The heater head 51 is provided therethrough with a passageway 63 for flow therethrough of a coolant as shown in FIGS. 12 and 18. This passageway 63 is provided at its ends with hose fittings **64*a* and 64*b* which are connected through hoses 65*a* and 65*b* and air-tight means such as fittings 66 provided through the wall of the vacuum box 22 to a rotary fitting (not shown) installed on the aforementioned hollow shaft 19.**

Along and over the entire lower surface of the heater head 51, a Teflon tape 71 is adhesively bonded. Immediately below and parallel to this Teflon tape 71, a heater strip 72 of ribbon form is stretched between and supported by heater strip support pins **76*a* and 76*b* respectively inserted through and held by heater strip anchor members 68*a* and 68*b*, which are secured to the opposite ends of the heater head 51 over insulating plates 67*a* and 67*b* interposed therebetween. Another Teflon tape 73 is adhesively bonded to and over the entire underside of the heater head 51 over the heater strip 72. Below and parallel to this Teflon tape 73 and substantially along one end of the heater strip 72, a heater wire 74 is stretched between support pins 78*a* and 78*b* respectively inserted through and held by anchor members 70*a* and 70*b*, which are secured to the opposite ends of the heater head 51 over insulating plates 69*a* and 69*b* interposed therebetween. Pieces of Teflon tape 75 of a specific number and specific width are wound and adhesively secured at specific positions on the heater wire 74.**

The support pins **76*a*, 76*b*, 78*a*, and 78*b* for the heater strip 72 and heater wire 74 are respectively connected through lead wires 77*a*, 77*b*, 79*a*, and 79*b* to terminals 80 installed in an air-tight manner through the wall of the vacuum box 22 and connected at their outside ends to slide rings 27 and 28 provided on the aforementioned turntable 21. These slide rings 27 and 28 are connected by way of carbon terminals (not shown) suspended from a support member 29 fixed to the hollow shaft 19, limit switches and other parts to a power source, the slide ring 27 being divided into equal divisions of the same number as the vacuum boxes 22** and being adapted to distribute power to only parts necessary for an impulse seal power source.

Each vacuum box 22 is provided on its inner side facing the axis of revolution with a hose 26 connected thereto at one end and connected at its other end to the aforementioned rotary valve mechanism and serving as a passageway for evacuation and introduction of atmospheric air. Around the entire peripheral edge of each vacuum box 22 to contact a platform plate 43, described hereinafter, a narrow packing 49 is imbeddedly provided to serve as an air-tight seal between the vacuum box and the platform plate.

The machine frame 18 is provided at the other end thereof with a vertical driving shaft 30 projecting upwardly from a driving device (not shown) and supporting a sprocket or chain wheel 31 fixed thereto. The chain wheel 31 is coupled to the aforementioned chain wheel 20 by the chain 32 passed therearound, whereby the chain wheel 20 is driven, and, at the same time, the platform plates 43 described hereinafter and connected to the chain 32 are conveyed.

More specifically, the platform plates 43 are caused to travel substantially along the travel path of the chain 32 as shown in FIG. 11, while the aforementioned vacuum boxes 22 travel in a circular path around the hollow shaft 19. These paths of the platform plates 43 and of the vacuum boxes 22 meet at a position A, where each vacuum box 22 becomes positioned directly above and aligned with one platform plate 43, and the vacuum box and platform plate thus integrally mated travel along the circular travel path of the vacuum box, while various packaging operations as described hereinafter are carried out, until a position B is reached. The vacuum box 22, and its platform plate 43 then separate at this position B, each thereafter continuing to travel along its respective travel path until it again is mated with a respective member at the position A.

At appropriate equal intervals along the chain 32 there are provided projecting brackets 34, each of which supports a slider support member 35 fixed thereto and slidably engaged with a vertical sliding column 36. Each column 36 is provided at its lower end with a roller 37 for rolling freely on rails 38 and 39 fixedly supported by posts 40 on the machine frame 18 and having a figure in plan view coninciding with the path of travel of the chain 32. These rails 38 and 39 are provided with a difference in height so as to control the vertical movement of each sliding column 36 thereby to prevent the packaged products 2 or 5 from interfering with the revolution of the vacuum boxes 22.

Each column 36 at its upper end centrally supports a support plate 41 rigidly fixed thereto. One of the aforementioned platform plates 43 is supported on this support plate 41 by way of a suitable number of springs 44 interposed therebetween. Horizontal movement of these plates 43 and 41 relative to each other is prevented by a suitable number of guide bars 42 fixed to the lower side of the platform plate 43 and slidably inserted through holes in the support plate 41.

A retaining seat 45 in the form of a corrugated plate of suitable size is fixed to the upper face of each platform plate 43 at a position corresponding to that on which an article being packaged is to be placed. Furthermore, a bolster block 46 is mounted on the platform plate 43 at a position confronting the position of the aforementioned heater head 51 when the vacuum box 22 is mated with the platform plate 43. A seal 47 made of a heat-resistant and elastic material is mounted on the bolster block 46. In addition, on the side of the bolster block 46 opposite from the retaining seat 45, there is provided a backing member 48 provided with a suitable number of slots 62 of required length and being so disposed that its upper surface is at subtantially the same level as the upper surface of the seat 47.

On one hand, in the interior of each vacuum box 22, there are mounted the aforementioned cutter blades 50 positioned to accomplish cutting cooperatively with the edges of the above mentioned slots 62 and having sharp tips.

Next, further details of the apparatus will be considered with reference to FIG. 11. Each package on which the vacuum packaging operation has been completed on the platform plate 43 is transferred by a transfer device 82 from the top of the platform plate 43 onto a belt conveyor 83 provided on the machine frame 18 and is thereby conveyed to the succeeding process (not shown). The aforementioned chain wheels 20 and 31 are provided with cutouts 84 for engagement with the slider support members 35, whereby interference with the movement of the chain 32 is prevented. A chain guide 33 is provided to guide the chain 32 in its span part of reflex or reversed curvature are viewed in plan view.

As the position designated by arrow M in FIG. 11, a package bag 1 which has been charged with a product content 2 or 5 is placed on a platform plate 43 passing by the position M. As this platform plate 43 advances further, as described above, it rises by a distance equal to the difference in height of the rails 39 and 38 and, at the position A mates with a corresponding vacuum box 22 as shown in FIG. 12. During this mating action, the surplus portion 10 of the package bag 1 is clamped between the aforementioned packing 49 and the upper surface of the platform plate 43. At the same time, the sharp ties of the cutter blades 50 fixed to the vacuum box 22 above the backing member 48 pass through respective slots 62 thereby to form slits 14 in the surplus portion 10.

Immediately after the forming of the slits 14 upon the mating of the vacuum box 22 and the platform plate 43, the aforementioned rotary valve mechanism operates, whereupon an evacuating device, acting through the hoses 25 and 26 evacuates the interior of the vacuum box 22, the pressure chamber 23, and the region above the diaphragm 56. This evacuation has no effect on the vertical movement of the heater head 51. On the other hand, since the outer surface of the product content 2 or 5 in the package bag 1 is tacky, as mentioned hereinbefore, the bag 1 is in a state of intimate adhesion to the content. However, at the initial stage of the evacuation, because of the appropriate provision of the slits 14, the bag 1, particularly on its upper side, becomes inflated. If this inflation were to be permitted to become excessive, it would become a cause of formation of undesirable wrinkles at the seal part 11 of the bag 1 during impulse sealing. Accordingly, the aforedescribed control plate 58 and springs 60 are provided to control this inflation, which is an important feature of this invention.

Another significant feature of the invention is the provision of the aforedescribed downward projection 61, which effectively prevents the formation of wrinkles during the above mentioned impulse sealing. Still another important feature of the invention is the provision of the aforedescribed retaining seat 45 of corrugated shape on each platform plate 43. This retaining seat 45 functions to minimize the area of contact between it and the package and to limit the contact to the crests of the coagulation in the longitudinal direction so as to prevent the closely adhering state of the bag 1 to the content product 2 or 5 from interfering with the evacuation, the bag 1 being caused to be inflated toward the valleys of the corrugations. It should be mentioned that the construction of this retaining seat is not limited to a corrugated configuration, an equivalent effect being obtainable of alternative configurations such as, for example, a parallel arrangement of round bars of suitable size.

Since the closely adhering state between the bag 1 and the content product 2 or 5 at the top and bottom surfaces thereof is disrupted, the interior of the bag 1, similarly as the interior of the vacuum box 22, also becomes evacuated, and when the desired degree of vacuum within the bag 1 has been obtained, the aforementioned rotary valve operates to introduce atmospheric air through the hose 25, whereupon the difference air pressure between the atmosphere and the interior of the vacuum box 22 acts on the diaphragm 56, whereby the piston disk 55 descends within the pressure chamber 23. Consequently, the heater head 51 descends and clamps the bag 1 between itself and the elastic seat 47.

After the bag 1 is thus clamped, the aforementioned limit switch (not shown) is turned "ON," and electric current is passed through the heater strip 72 and the heater wire 74, whereupon the bag 1 is heat sealed, and, at the same time, the heater wire 74, heat cuts the bag 1 at parts thereof other than those corresponding to the Teflon tape 75 wound around the heater wire 74, residual parts 13 being left as shown in FIG. 9 and a surplus part 10 being formed. While the residual parts 13 remain as a result of the heat insulation afforded by the Teflon tape 75, some heat is transmitted thereto, whereby these residual parts 13 become very thin membranes. Cooling water is continually passed at an appropriate flow rate through the passageway 63 of the heater head 51 to cool rapidly the sealed part 11 thereby to strengthen the seal.

The reason why the heater strip 72, the heater wire 74, and the lead wires 77*a*, 77*b*, 79*a*, and 79*b* are provided separately is that it is desirable that the heat sealing and heat cutting operations be made adjustable in accordance with the material of the package bag 1.

Upon completion of the above described vacuum packaging process, each package (as shown in FIG. 9) is conveyed through the point B in FIG. 11, where the vacuum box 22 separates from the platform plate 43 bearing the package, which descends as a result of the difference in the level of the rail 39. The package is thus further conveyed to the transfer position, where it is transferred by the transfer device 82 onto the belt conveyor 83 to be conveyed to the succeeding process of immersion in hot water, immediately before which, the surplus portion 10 is removed from the package.

As described hereinbefore, each platform plate 43 is mounted on its support plate 41 by way of springs 44 interposed therebetween and with guide bars 42 provided for vertical alignment of the two plates. In conjunction with this spring mounting, the distance of ascent or upward stroke of the platform 43 at the position A in FIG. 11, where it ascends to mate with a corresponding vacuum box 22 is set somewhat long thereby to ensure positive and full contact of the packing 49 imbeddedly fixed to the rim of the vacuum box 22 with the upper surface of the platform plate 43. In this manner, process trouble is effectively prevented.

In the packaging operation by the vacuum packaging apparatus of this invention, the package bag 1 is maintained substantially constant, and packaging is possible under the same conditions even when the content product 2 or 5 is of irregular shape. Accordingly, the method and apparatus of this invention are highly effective in facilitating material management and work process.

In accordance with this invention in still another aspect thereof, the prinary operation of the vacuum pump for evacuation of the vacuum chambers is greatly assisted by causing vacuum valves about to be evacuated to be communicative by a novel rotary valve mechanism with the vacuum boxed already under vacuum and before introduction thereinto of atmospheric air thereby to reduce the total power required for evacuation.

Figure 19:
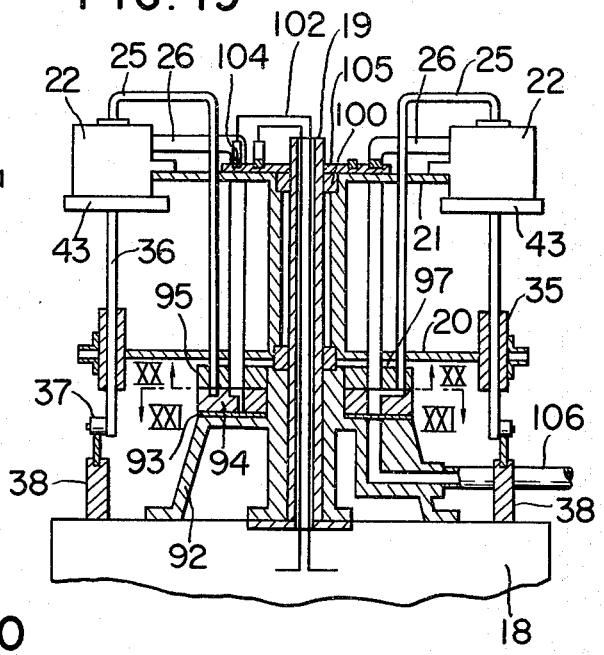
FIG. 19 is an elevation, in vertical section, showing the essential parts of one example of a rotary valve mechanism of the vacuum packaging apparatus according to the invention.
Figure 20:
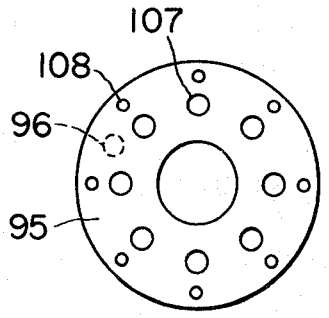
FIG. 20 is a plan view of a rotary valve in the mechanism illustrated in FIG. 19.
Figure 21:
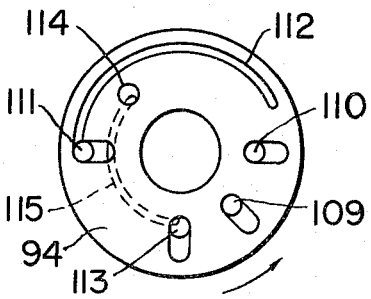
FIG. 21 is a plan view of a fixed valve seat for operating cooperatively with the rotary valve illustrated in FIG. 20.

In one example of this rotary valve mechanism as illustrated in FIGS. 19, 20 and 21, a pedestal 92 is mounted on the machine frame 18 around the aforementioned hollow shaft 19, and a fixed valve seal 94 is secured to the upper part of the pedestal 92 over a packing 93 interposed therebetween. A rotary valve 95 is rotatably and coaxially seated on the fixed valve seat 94.

For holding the rotary valve 95 against rotation, a hole 96 is formed therein to a suitable depth to be loosely engaged with a projecting pin 97 fixed to the chain wheel 20.

As described hereinbefore, the chain wheel 20 and the turntable 21 are integrally secured to each other and are rotatably supported on a bearing 100 about the hollow shaft 19 fixed to the pedestal 92.

The hollow shaft 19 serves also as a passageway for power supply conductor wires 102 for the heating devices installed in the vacuum boxes 22. These conductor wires are connected to respective carbon brushes in contact with contact rings 104 imbeddedly secured to an insulating disk 105 disposed on the turntable 21. As described herein before, a plurality of vacuum boxes 22 are fixed to the outer periphery of the turntable 21 and respectively accommodate therewithin the heating and cutting devices described hereinbefore. Description of the vacuum boxes 22, the platform plates 43, and related mechanisms and devices has been set forth hereinbefore and, therefore, will not be repeated.

The rotary valve 95 is provided with through holes 107 and 108 respectively of the same number as the vacuum boxes 22. These holes 107 and 108 are communicatively connected respectively through hoses 26 and 25 to the vacuum chambers within the vacuum boxes 22 and the pressure chambers 23 within the vacuum boxes 22. The fixed valve seat 94 is provided through holes 109, 110, and 111. The through hole 109 is communicatively connected by a hose 106 to a vacuum pump (not shown). The through hole 110 functions in the case where a plurality of the vacuum pumps are used and are of the same number as the vacuum pumps used. The through hole 111 functions as a release port for returning atmospheric air into the pressure chambers and vacuum chambers of the vacuum boxes 22. An arcuate groove 112 is provided for returning atmospheric air somewhat early to the vacuum chambers.

The through holes 109, 110, and 111 are formed with partially expanded slot openings only at the sliding surface of the fixed valve seat 94 so as to register and communicate with the through holes 107 and 108 in the rotary valve 95. The fixed valve seat 94 is further provided with a through hole 113 for communicating the evacuated state of a vacuum chamber prior to full release of vacuum to a vacuum chamber still not under vacuum immediately prior to its communication with the vacuum pump. This through hole 113 communicates with an arcuate groove 115 formed on the reverse or bottom side of the fixed valve seat 94. One portion of this through hole 113 is expanded into a slot form for communication between the vacuum chambers and pressure chambers.

When the vaccum boxes 22 revolve in the arrow direction in FIG. 21, the through hole 113 functions immediately before the through hole 109 for communication with the primary vacuum pump, whereupon the vacuum chamber of a vacuum box 22 which has completed its vacuum packaging operation but is still in its evacuated state communicates through the holes 113 and 114 and the groove 115 with the vacuum chamber of a vacuum box still to be evacuated. Then, since the total volumetric capacity of the two vacuum chambers is twice that of one vacuum chamber, the initial degree of vacuum expressed as 760 mm.Hg., for example, is halved to 380 mm.Hg.

In other words, even before the operation of the primary vacuum pump, the required work of evacuation is halved, whereby this work can be accomplished by a vacuum pump of relatively low capacity. Conversely, if a vacuum pump of a capacity according to prior practice is used, the packaging capacity of the vacuum packaging apparatus can be increased.

I claim:

1. A method of vacuum packaging a commodity, particularly a livestock meat for food, which comprises: charging a specific quantity of the commodity into a package bag made of a heat-shrinkable plastic film of a substantially constant overall length, which is sufficient for packaging said quantity ranging from a relatively small quantity to a relatively large quantity of the commodity, and having a closed bottom end and an open top end, in a manner to leave a specific unfilled part at the bottom end of the bag; placing the bag thus charged in a specific position in an evacuating device of a vacuum packaging apparatus; placing the bag in said specific position under a vacuum thereby to evacuate the interior thereof, excessive inflation of the bag being prevented by means provided therefor; sealing the bag with a seal part extending transversely thereacross on the side of the commodity opposite from the bottom end of the bag, a specific unfilled part being left between the seal part and the commodity; at the same time cutting the bag with a cut extending transversely thereacross except for an uncut part for temporarily retaining the open end of the bag, constituting a surplus part, attached to the remainder of the bag, the cut being on the outer side of the seal part; removing the surplus part; and immersing the resulting vacuum package in hot water, preferably at a temperature of 80°C to 85°C for a period of the order of 2 to 10 seconds thereby to cause heat shrinkage of the bag.

2. A method of vacuum packaging a commodity according to claim 1 in which, prior to the step of placing the bag under a vacuum, holes are made therein at positions on the outer side of said cut in the surplus part thereby to facilitate evacuation of the interior of the bag.

3. Apparatus for vacuum packaging a commodity comprising:

a plurality of support members each adapted to hold thereon a package bag made of a heat-shrinkable plastic film and having a closed bottom end and an open top end and containing a specific quantity of a commodity with a specific unfilled part left at the bottom end of the bag;

a plurality of vacuum structures each adapted to mate with one of the support members to form therebetween an air-tight chamber accomodating the package bag;

means for conveying the vacuum structures at a constant linear speed and with constant spacing therebetween along a first circulatory path;

means for conveying the support members at said constant linear speed and with said constant spacing therebetween along a second circulatory path superimposed in a portion thereof relatively with the first circulatory path over a portion thereof and for moving the support members relatively into mating state with respective vacuum structures over said superimposition portion and separating the support members from the respective vacuum structures at the end of said portion;

means for evacuating said air-tight chambers;

means for preventing excessive inflation of each bag under vacuum;

means provided within said chamber for sealing each bag with a seal part extending transversely thereacross on the side of the commodity opposite from the bottom end of the bag, a specific unfilled part being left between the seal part and the commodity;

means provided within said chamber for cutting the bag with a cut extending transversely thereacross;

means for restoring the pressure within each vacuum chamber to atmospheric pressure upon completion of vacuum packaging therewithin; and means for transferring packages thus vacuum packaged from the support members onto means for conveying the packages to a succeeding process.

4. Apparatus for vacuum packaging a commodity according to claim 3, further including a rotary valve mechanism operated synchronously with said means for conveying the vacuum structures to communicate the interior of an evacuated air-tight chamber under vacuum about to be restored to atmospheric pressure to the interior of another air-tight chamber about to be evacuated thereby to equalize the vacuum state between the two chambers and thereby to reduce the power required to evacuate the second chamber.

5. Apparatus for vacuum packaging a commodity according to claim 3 in which said means for preventing excessive inflation of each bag under vacuum comprises a retaining seat mounted on each of said support members to hold thereon said package bag, and a control plate resiliently secured to each of said vacuum structures to suppress the package bag onto said retaining seat when the vacuum structure mates with the support member to form the air-tight chamber therebetween.

6. Apparatus for vacuum packaging a commodity according to claim 5 in which said retaining seat has parallel grooves extending in the bottom-to-top direction of the bag.

7. Apparatus for vacuum packaging a commodity according to claim 5 in which said control plate has a concave surface engageable with the package bag.

8. Apparatus for vacuum packaging a commodity according to claim 3 in which said means for preventing excessive inflation of each bag under vacuum comprises a projection on said vacuum structure to engage and suppress the package bag at a part thereof slightly toward the bottom end of the bag from said seal part.

9. Apparatus for vacuum packaging a commodity according to claim 3 in which said means for cutting the bag with a cut has means to cut the bag except for an uncut part for temporarily retaining the open end of the bag, constituting a surplus part attached to the remainder of the bag.

10. Apparatus for vacuum packaging a commodity according to claim 3, further including means for cutting openings in each bag in the surplus part on the outer side of said cut thereby to facilitate evacuation of the interior of the bag.

11. Apparatus for vacuum packaging a commodity according to claim 10 in which said means for cutting openings in each bag comprises a backing member mounted on each of said support members and having slots therein, and cutter blades fixed to each of said vacuum structures and positioned in a manner such that when the vacuum structure mates with the support member to form the air-tight chamber therebetween the cutter blades are inserted in the slots, respectively, to cut said openings in the bag put on said support member.

* * * * *